US009541876B1

(12) United States Patent
Cousoulis et al.

(10) Patent No.: US 9,541,876 B1
(45) Date of Patent: Jan. 10, 2017

(54) IMAGING DEVICE WITH DIAGNOSTIC TESTING FOR FATAL ERRORS

(71) Applicant: Lexmark International, Inc., Lexington, KY (US)

(72) Inventors: Marc Cousoulis, Lexington, KY (US); Alexander Johannes Geyling, Lexington, KY (US); Calvin Dale Murphy, Georgetown, KY (US); Niko Jay Murrell, Lexington, KY (US); William Claiborne Ryle, Williamstown, KY (US); Travis Alan Riggs, Lexington, KY (US); Edward Alan Rush, Richmond, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 14/866,339

(22) Filed: Sep. 25, 2015

(51) Int. Cl.
*G03G 15/00* (2006.01)

(52) U.S. Cl.
CPC ..... *G03G 15/5058* (2013.01); *G03G 15/5041* (2013.01); *G03G 15/55* (2013.01)

(58) Field of Classification Search
CPC ..... G03G 15/0189; G03G 15/0184; G03G 15/5012; G03G 15/5041; G03G 15/5054; G03G 15/5058; G03G 15/55; G03G 15/553; G03G 15/556; G03G 2215/00059
USPC ..... 399/49, 38, 75, 76, 9
See application file for complete search history.

(56) References Cited

U.S. PATENT DOCUMENTS

2011/0026943 A1* 2/2011 Konishi ..... G03G 15/55 399/9
2015/0010318 A1* 1/2015 Cannon ..... G03G 15/161 399/71
2015/0370196 A1* 12/2015 Ozaki ..... G03G 15/5041 399/9

* cited by examiner

*Primary Examiner* — Sophia S Chen

(57) ABSTRACT

A method and system are disclosed for detecting a fatal error condition in a printing device having an intermediate transfer member for facilitating toner transfer, including sensing a reflectance value of the intermediate transfer member at a first predetermined time; comparing the sensed reflectance value at the first period of time to a predetermined threshold; sensing a reflectance value of the intermediate transfer member at a second predetermined time after the predetermined first time; and comparing the sensed reflectance value of the intermediate transfer member at the second period of time to the predetermined threshold. If each of the sensed reflectance value at the first predetermined time and the sensed reflectance value at the second predetermined time is greater than the predetermined threshold, the method includes selectively suspending further printing operations until the imaging device is serviced.

18 Claims, 5 Drawing Sheets

IMAGING DEVICE WITH DIAGNOSTIC TESTING FOR FATAL ERRORS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

This invention relates to an electrophotographic printer having an imaging device, and, more particularly, to a system and method for diagnosing potentially catastrophic mechanical failures occurring in the imaging device.

2. Description of the Related Art

In a color electrophotographic process, toner is transferred by electrostatic means to an intermediate transfer member (ITM) at each of four or more successive imaging stations, with each imaging station representing a different color plane. Toner is accumulated onto the ITM belt and then transferred onto a media sheet by reversing the electrostatic field. This transfer onto paper is not 100 percent efficient, and some small amount of toner is left on the ITM belt that needs to be removed prior to a subsequent image to be accumulated on the ITM belt.

Second transfer is where the image is transferred from the ITM belt to the sheet of media. At the second transfer, a second transfer roll and a backup roll form a transfer nip. The media of media enters into the second transfer nip between the second transfer roll and the ITM belt. Voltages are applied to the second transfer roll and the backup roll to develop an electric field therebetween. The electric field at second transfer is constructed in a way to pull the toner off of the ITM belt onto the sheet of media. Second transfer is not 100% efficient, so residual toner is left on the ITM belt. The residual toner after second transfer is typically cleaned before a new image is placed on the ITM belt. If the toner is not cleaned off of the belt, the residual toner could contaminate the next media sheet printed.

Following second transfer, a cleaning unit typically employs a blade to scrape residual toner from the ITM belt. The residual toner builds up and is moved away from the blade by an auger into a waste toner box. The waste toner box is periodically replaced by the customer.

Occasionally, a "toner dump" can occur in a printing system. Causes of a toner dump include a bias voltage problem at the developer roll of a developer unit; a seal failure in a toner bottle; a lower seal failure in a developer unit; the photoconductive drum failing; and the ITM belt cleaner unit failing due seal failure or the cleaner blade flipping. Without looking at the printed sheet of media, there is little way to detect the occurrence of a toner dump. The imaging device is blind to this failure mode until a catastrophic mechanical failure occurs that results in a service call. Unfortunately, not only are toner dumps not easily detectible but the causes of a toner dump can quickly result in mechanical failure.

If a toner dump occurs, toner around the auger in the cleaning unit bridges in such a way that toner does not drop down into the waste toner box. As a result of the toner blockage, the torque on the auger may increase as a result but does not cause the auger or belt to stall. The auger eventually builds up enough toner in the end of the cleaning unit to start to buckle the auger. Buckling the auger puts a downward force on the cleaner blade, which causes the blade to flip, the auger to seize, or the cleaning unit to leak. The ITM belt will be destroyed and must be replaced.

The volume in and around the auger of the cleaning unit could be increased to handle the rare occasion when toner is dumped onto the ITM belt, but this requires additional volume in the machine in a location that is typically already cramped for space. With additional volume comes additional cost.

Even if the volume around the auger were increased, the imaging device would still be susceptible to other downstream failure modes that are not as easily remedied. Some of the excess toner on the belt may be transferred to sheets of media. Excessive toner coverage on the media sheets caused by a toner dump may result in failure by the fusing assembly of the imaging device. Poor fuse grade may result in a fuser roll being undesirably wrapped by a sheet of media or toner contaminating media transport guides internal and external the fuser assembly. Both of these result in a fuser replacement or a service call. Additionally, widespread machine contamination resulting from a toner dump may result in replacement of components, assemblies and modules within the imaging device.

In addition, dual component development (DCD) based imaging devices are further complicated by conditions that can relatively quickly lead to mechanical failure within the imaging device. A DCD based imaging device is one in which a development mix contains a portion of polymeric resin based toner and a magnetic carrier. Typically, the magnetic carrier will have a polymeric coating constructed of a triboelectrically different resin than the toner. When the toner is mixed with the carrier, the toner will charge to one polarity, while the carrier coating will charge to the opposite polarity. At that point, the toner will adhere to the oppositely charged carrier bead.

The magnetic carrier is utilized for two purposes. One purpose is to allow for the charging of the toner particles to a range appropriate for toner development, and the second purpose is to allow for the usage of a magnetic roller to transport the toner into the development zone between the magnetic roller and the photoconductor.

The final charge on the toner particles is a function of multiple kinetic and material factors within the development mix. Some of these factors may be, but are not limited to, the material choices for the toner and the carrier coatings, the amount of mix energy utilized to combine the toner and the carrier, and the weight concentration of toner to the carrier in the developer mix. The weight concentration of toner to carrier is commonly referred to as the toner concentration (TC) of the developer mix. If the TC increases, then the available surface area of the carrier per toner particle decreases, reducing the charge of the toner. If the toner concentration increases, then the available surface area of the carrier per toner particle increases, increasing the charge of the toner.

To maintain substantially constant toner charge in a development system, the amount of toner printed out of the developer unit needs to be known and the same amount must be fed back into the development sump of the developer unit to maintain a level of TC within a specific operating range.

Any transition to a TC outside of this range could cause irreparable damage to the development mix and potentially the entire imaging system. If the TC gets too high, the toner charge and the carrier charge will both get too low causing "fogging" or "dusting" of the final image with toner and the possibility of bead carry-out (BCO) which is the loss of carriers to the photoconductor. A very low TC could lead to premature aging of the carrier which can also result in low carrier charge leading to BCO. At high levels of BCO, the development sump of the developer unit will become depleted of carriers, significantly reducing the life of the development system. At extremely high levels of BCO, other imaging system components (photoconductors, cleaner blades, transfer belts, etc.) can become irreparably damaged.

Though both undesirable changes in TC should be noticed by the user of the imaging device, thereby providing the user with an opportunity to initiate remedial measures so as to avoid irreparable damage. However, an issue arises when a user sends a very long print job and does not visibly monitor the output. By the time the user of imaging device may notice that the image quality is not acceptable, irreparable damage may have already occurred to the development system and the imaging system as a whole.

SUMMARY

Example embodiments overcome shortcomings of existing electrophotographic imaging devices and satisfy a significant need for detecting a fatal error condition before the electrophotographic imaging device experiences serious damage requiring costly servicing. According to an example embodiment, a method for detecting an error in an imaging device includes sensing a reflectance value of the ITM belt at a first predetermined time; comparing the sensed reflectance value at the first period of time to a predetermined threshold; sensing a reflectance value of the ITM belt at a second predetermined time after the predetermined first time; and comparing the sensed reflectance value of the ITM belt at the second period of time to the predetermined threshold. If each of the sensed reflectance value at the first predetermined time and the sensed reflectance value at the second predetermined time is greater than the predetermined threshold, the method includes selectively suspending further printing operations until the imaging device is serviced. If the sensed reflectance value at the first predetermined time is greater than the predetermined threshold, then prior to sensing the reflectance value of ITM belt at the second predetermined time, the method includes resetting the imaging device and rotating the ITM belt while sensing the reflectance value thereof at the second predetermined time.

Another example embodiment includes an imaging device having an ITM belt for transferring a developed toner image during an image transfer operation; a sensing unit operative to detect an amount of toner on the ITM belt during the image transfer operation; and a controller coupled to the sensing unit and operative to compare a first output of the sensing unit during the image transfer operation to a predetermined threshold and selectively halting further printing operations based at least in part on the comparison. Specifically, upon the output of the sensing unit being greater than the predetermined threshold, the controller controls the imaging device to perform a reset operation, move the ITM belt a predetermined distance following the reset operation, compare the predetermined threshold to a second output of the sensing unit during movement of the ITM belt and perform the selective halting following an affirmative determination that the second output is greater than the predetermined threshold.

In an example embodiment, instead of halting further print operations, the imaging device attempts to identify the developer unit of the imaging device that caused the output of the sensor to exceed the predetermined threshold. Upon successfully identifying such developer unit, the controller may disable the identified developer unit from future print operations until imaging device is serviced, thereby allowing printing with the remaining developer units that were not disabled. In another example embodiment, upon the output of the sensing unit being greater than the predetermined threshold, the imaging device may create a clearable error condition in which a user is provided an opportunity to determine whether printing is to continue.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings, wherein.

DETAILED DESCRIPTION

Figure 1:
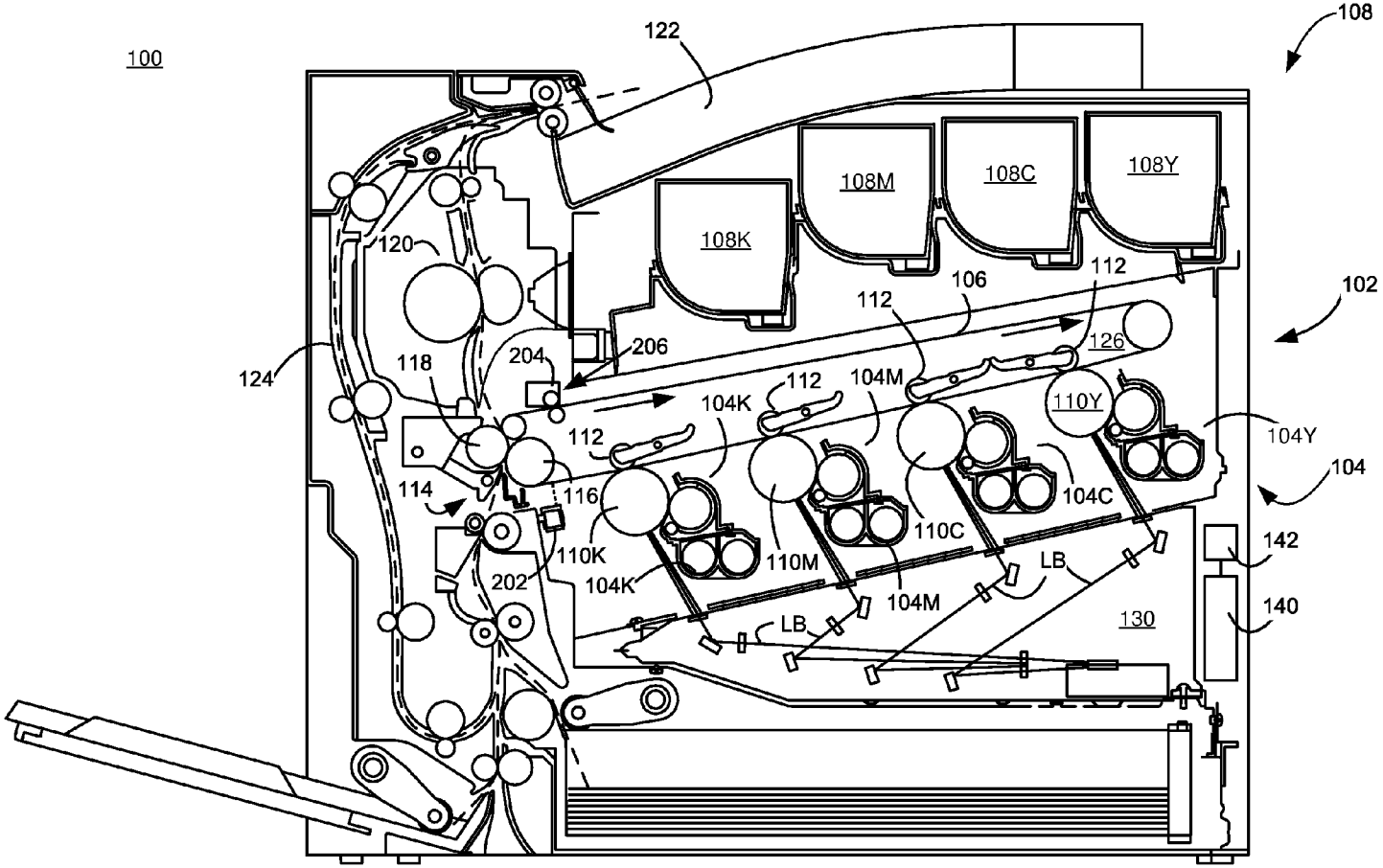
FIG. 1 is a side view of a color electrophotographic printer with an ITM belt and cleaning assembly according to example embodiments of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color imaging device 100 according to an example embodiment. Imaging device 100 includes a first transfer area 102 having four developer units 104—black developer unit 104K, magenta developer unit 104M, cyan developer unit 104C and yellow developer unit 104Y—that substantially extend from one end of imaging device 100 to an opposed end thereof. Developer units 104 are disposed along an intermediate transfer member (ITM) belt 106. Each developer unit 104 holds a different color toner. Developer units 104 may be aligned in order relative to the direction of ITM belt 106 indicated by the arrows in FIG. 1, with the yellow developer unit 104Y being the most upstream, followed by cyan developer unit 104C, magenta developer unit 104M, and black developer unit 104K being the most downstream along ITM belt 106.

Each developer unit 104 is operably connected to a toner reservoir 108 for receiving toner for use in an imaging operation. Toner reservoirs 108 include black toner reservoir 108K, magenta toner reservoir 108M, cyan toner reservoir 108C and yellow toner reservoir 108Y. Each toner reservoir 108 is controlled to supply toner as needed to its corresponding developer unit 104. Each developer unit 104K, 104M, 104C and 104Y is associated with a photoconductive member 110K, 110M, 110C and 110Y, respectively, that receives toner therefrom during toner development to form a toned image thereon. Each photoconductive member 110 is paired with a transfer member 112 for use in transferring toner to ITM belt 106 at first transfer area 102.

During color image formation, the surface of each photoconductive member 110 is charged to a specified voltage, such as −800 volts, for example. At least one laser beam LB from a printhead 130 is directed to the surface of each photoconductive member 110 and discharges those areas it contacts to form a latent image thereon. In one example embodiment, areas on the photoconductive member 110 illuminated by the laser beam LB are discharged to approximately −100 volts. Each of developer units 104 then transfers toner to its corresponding photoconductive member 110 to form a toner image thereon. The toner is attracted to the areas of the surface of photoconductive member 110 that are discharged by the laser beam LB from the printhead 130.

ITM belt 106 is disposed adjacent to each developer unit 104. In this example embodiment, ITM belt 106 is formed as an endless belt disposed about a drive roller and other rollers. During imaging device operations, ITM belt 106 moves past photoconductive members 110 in a clockwise direction as viewed in FIG. 1. One or more of photoconductive members 110 applies its toner image in its respective color to ITM belt 106. For mono-color images, a toner image is applied from a single photoconductive member 110K. For multi-color images, toner images are applied from two or more photoconductive members 110. In one example embodiment, a positive voltage field formed in part by transfer member 112 attracts the toner image from the associated photoconductive member 110 to the surface of moving ITM belt 106.

ITM belt 106 rotates and collects the one or more toner images from the one or more developer units 104 and then conveys the one or more toner images to a media sheet at a second transfer area 114. Second transfer area 114 includes a second transfer nip formed between at least one back-up roller 116 and a second transfer roller 118.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into output media area 122 or enters duplex media path 124 for transport to second transfer area 114 for imaging on a second surface of the media sheet.

In preparation for the next imaging device operation, ITM belt 106 is cleaned of residual toner by a cleaning unit 204. Removal of the residual toner is necessary prior to preparing ITM belt 106 to receive a new image otherwise the residual toner may be carried over the succeeding imaging device operation and will result in a dirty printed image. As shown, a toner patch sensor (TPS) 202 may be provided in imaging device 100 to assess the quantity of toner transferred to ITM belt 106 by developer units 104 and provide feedback for determining whether or not to adjust an operating characteristic of imaging device 100. Cleaning unit 204 may be a cleaning unit as described in U.S. Pat. No. 7,693,445, which is assigned to the assignee of the present disclosure and incorporated by reference herein in its entirety. TPS 202 may emit and reflect light off of a portion of ITM belt 106 to determine the amount of toner that was transferred during the toner transfer process. TPS 202 may include a light source providing light and a detector which may be sensitive to the emitted or luminescent, fluorescent and/or phosphorescent light. Light sources may include LED, lasers, incandescent lights, etc. Detectors may include various optical detectors, such as photoresistors, photodiodes, etc. TPS 202 is located downstream of first transfer area 102 and upstream of second transfer area 114. It is understood that cleaning unit 204 may be disposed anywhere along ITM belt 106 so long as it is located downstream of second transfer area 114 so as to provide a cleaned ITM belt 106 to first transfer area 102 for a subsequent toner transfer operation.

Imaging device 100 further includes a controller 140 and memory 142 communicatively coupled thereto. Though not shown in FIG. 1, controller 140 may coupled to components and modules in imaging device 100 for controlling same. For instance, controller 140 may be coupled to toner reservoirs 108, developer units 104, photoconductive members 110, fuser 120, a drive mechanism 126 for ITM belt 106, printhead 130, TPS 202, and cleaning unit positioning mechanism 206. It is understood that controller 140 may be implemented as any number of controllers and/or processors for suitably controlling imaging device 100 to perform, among other functions, printing operations.

According to an example embodiment, TPS 202 is used to detect the occurrence of a toner dump and in doing so, prevent damage to the cleaning unit 204, fuser assembly 120, or other parts of imaging device 100 that are upstream of the toner failure. In general terms, TPS 202 may be used to monitor the amount of toner on ITM belt 106 and compare the monitored amount to an expected value at some predetermined time or interval. If TPS 202 detects excessive toner being placed on ITM belt 106, corrective actions are taken or an error is issued to shut down the process before any significant damage is done to cleaning unit 204, fuser assembly 120, and/or imaging device 100.

According to some example embodiments, tests for detecting the presence of a toner dump event may be taken at several times during the printing process. In one embodiment, TPS 202 monitors the amount of toner on ITM belt 106 during the interpage gap of a print job. An advantage of performing the test during the interpage gap of a print job is that there should be no toner on ITM belt 106 in the interpage gap and the sampling frequency would allow imaging device 100 an opportunity to respond prior to a catastrophic failure. In addition or in the alternative, tests could be performed during run-in and run-out of an imaging operation, or during calibration.

Monitoring the output of TPS 202 in this way, a loss of bias during a large print job, may still result in a failure. A more complex TPS monitoring implementation involves constantly monitoring TPS 202 at a relatively low frequency, such as after every 10 mm of travel of ITM belt 106. If TPS 202 detects an amount of toner above an expected threshold, corrective actions are taken. This method would allow for the fastest problem identification. However, life of TPS 202 may be negatively impacted and the algorithm would have to account for varying amounts of toner on ITM belt 106 from print job to print job.

Figure 2A:
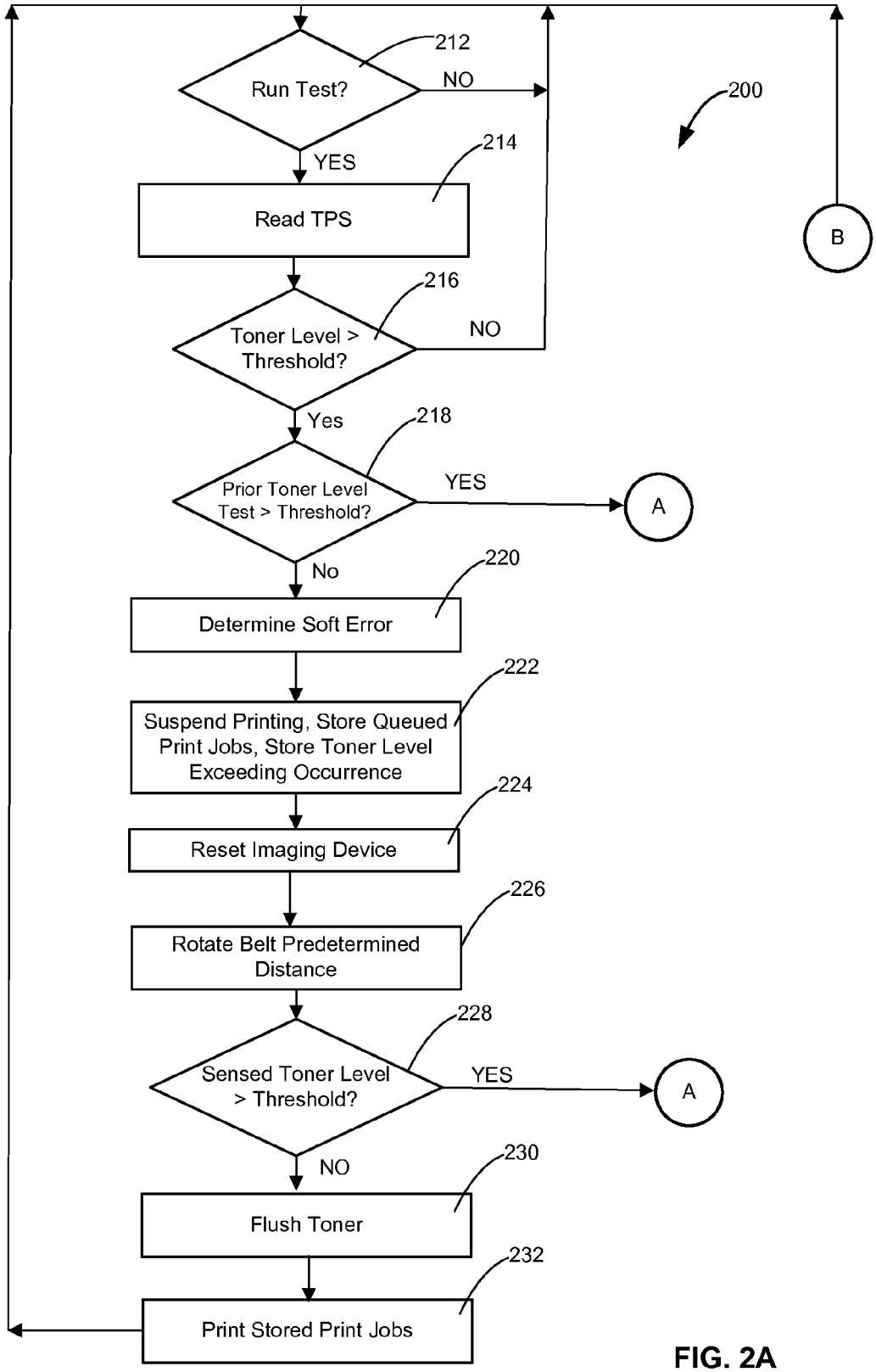
FIGS. 2A, 2B and 2C are flowcharts illustrating an operation of the imaging device according to example embodiments.
Figure 2B:
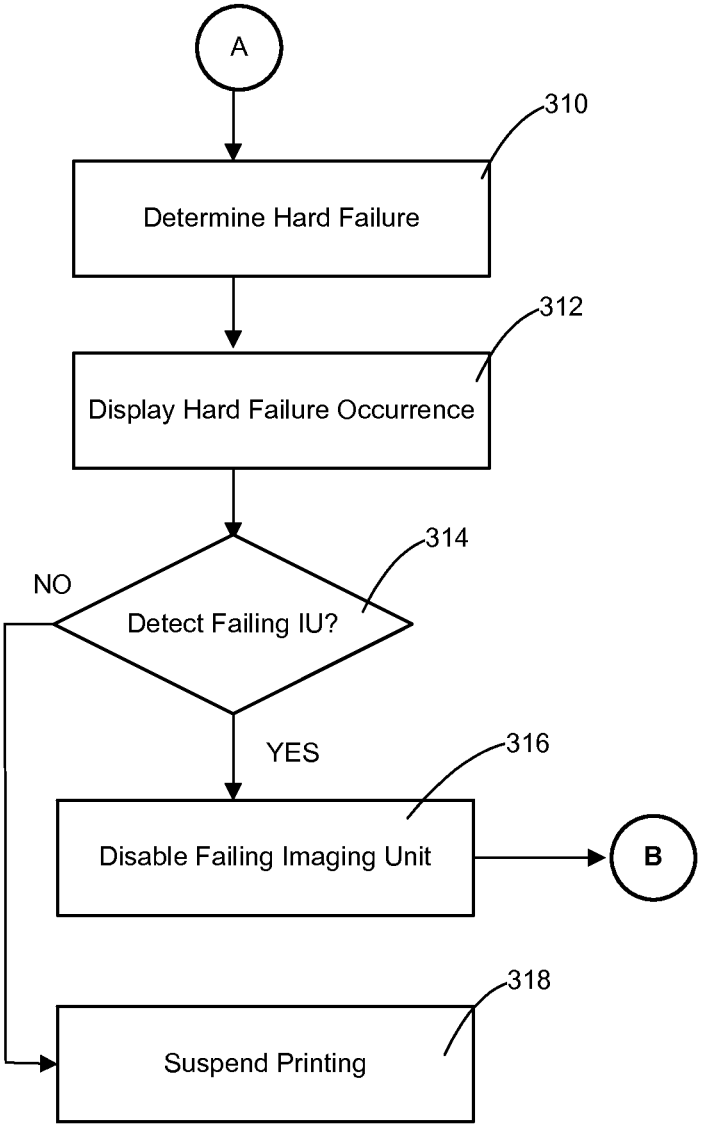

The operation of the imaging device will be described with respect to FIGS. 2A and 2B illustrating a method 200 according to an example embodiment. At 212, controller 140 determines whether a test for detecting the existence of a toner dump is to be performed. As mentioned, the test could be performed during the interpage gap of a print job, during calibration of imaging device 100, or at predetermined intervals. Upon an affirmative determination that a test is to be performed, TPS 202 is sensed at 214. If controller 140 determines at 216 that the amount of toner sensed by TPS 202 is less than a predetermined amount, indicative of a normal print operation, then no further action is taken and controller 140 waits for the next time a test is to be taken. However, if controller 140 determines that the amount of toner sensed by TPS 202 is greater than the predetermined amount, indicative of the occurrence of a toner dump, controller 140 determines at 218 whether the toner level sensed by TPS 202 exceeded the predetermined threshold in a prior test. If so, then the method continues to FIG. 2B, which is described below. If there was no prior test in which the toner level sensed by TPS 202 exceeded the predetermined threshold, then controller 140 determines a soft error has occurred at 220.

Following the determination by controller 140 that a soft error relating to a toner dump has occurred, controller 140 controls imaging device 100 to suspend printing at 222. In addition, existing print jobs in the queue of imaging device 100 are stored in nonvolatile memory. A bit may also be set in the nonvolatile memory to store, for example, the occurrence of the soft error.

Next, controller 140 controls imaging device 100 to reset at 224. When imaging device 100 is powered up following being reset at 224, controller 140 controls ITM belt 106 at 226 to move so that the portion of ITM belt 106 that is adjacent the developer unit 104 that is farthest from TPS 202 along ITM belt 106, which in this case is yellow developer unit 104Y as shown in FIG. 1, reaches TPS 202. TPS 202 is monitored again at 228. If the toner sensed by TPS 202 again exceeds the predetermined threshold at 228, the method proceeds to the flowchart of FIG. 2B. If the toner sensed by TPS 202 does not exceed the predetermined threshold at 228, controller 140 determines the problem has been fixed, toner is flushed from imaging device 100 at 230, the previously stored print jobs are printed at 232 and control returns to act 212 to await the next testing for a toner dump condition.

Following an affirmative determination at acts 218 and 228, control proceeds to FIG. 2B in which a hard failure is determined at 310 by controller 140. Controller 140 then controls the user interface display panel of imaging device 100 to communicate the hard error at 312. The display panel may instruct the user of imaging device 100 to check the toner bottles 108 and/or developer units 104, or to initiate a service call. Further, controller 140 may identify at 314 the particular toner bottle 108 and corresponding developer unit 104 which caused the toner dump. This identification may be based solely on the toner color previously sensed by TPS 202. However, cyan and magenta toner, for example, may be too difficult to discern so that additional information about printed image from the raster image processor (not shown) of imaging device 100 may be used to detect a difference. In the event imaging device 100 is able to determine at 314 the toner bottle 108 and/or developer unit 104 which caused the toner dump, controller 104 may temporarily disable the failing toner bottle 108 and developer unit 104 from subsequent printing operations at 316 so that imaging device 100 may continue to print in some capacity until it is serviced. In the event imaging device 100 is unable to determine the toner color corresponding to the toner bottle 108 and/or developer unit 104 which caused the toner dump, controller 140 may suspend printing at 318 until imaging device 100 is suitably serviced.

Figure 2C:
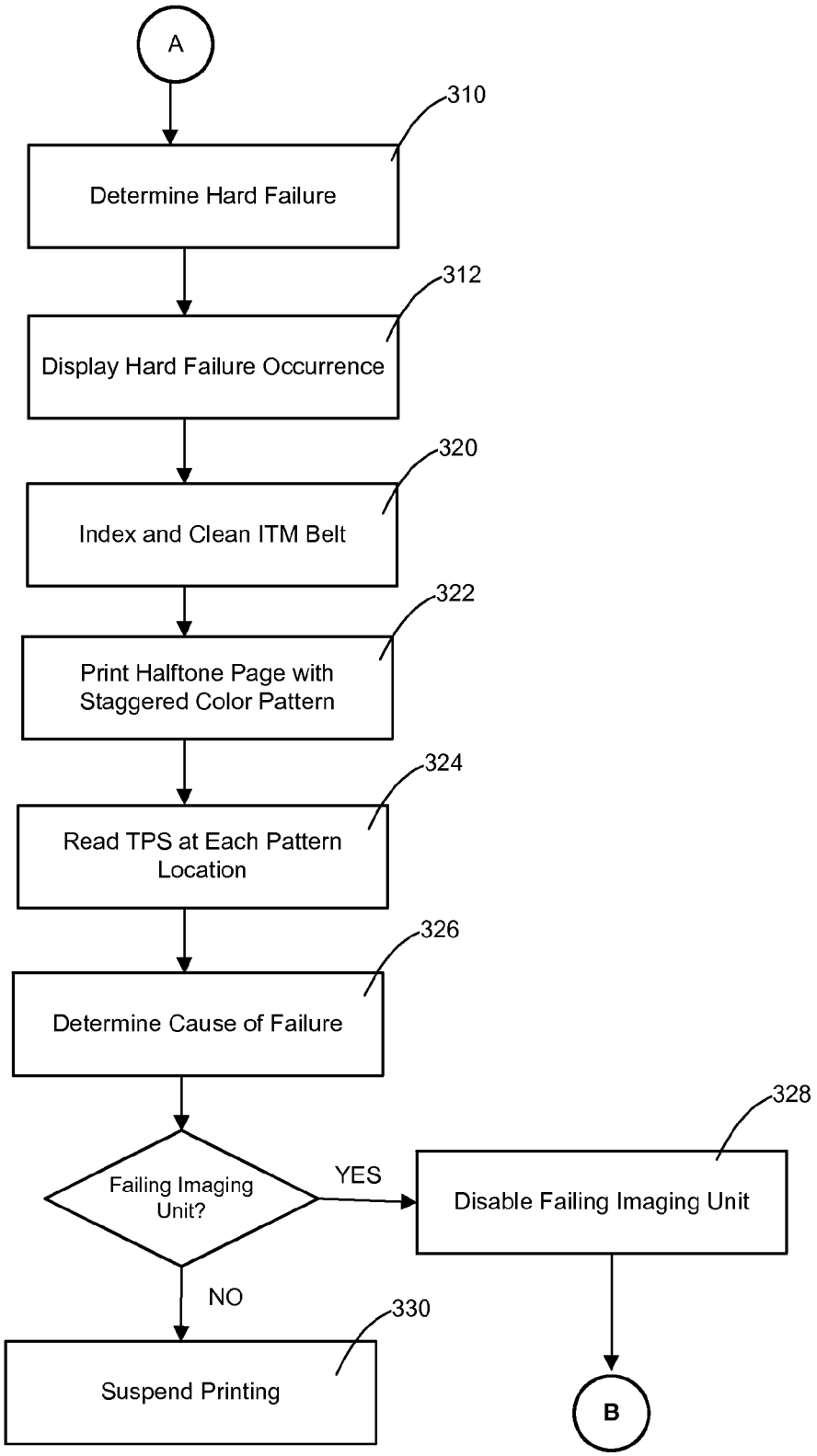

Alternatively, imaging device 100 may perform an additional test to identify the source of the failure. With reference to FIG. 2C, and following an affirmative response to acts 218 or 228 in FIG. 1, imaging device 100 may perform acts 310 and 312 as described above with respect to FIG. 2B, and then index ITM belt 106 so as to clean it with cleaning unit 204 at 320. Controller 140 may then cause at 322 a halftone image corresponding to a sheet of media to be developed and transferred onto ITM belt 106 at first transfer area 102. In a first example alternative embodiment, the four developer units 104Y, 104C, 104M and 104K are turned on at different times, thereby resulting in four color planes (yellow, cyan, magenta and black) that are staggered relative to each other along ITM belt 106. In a second example alternative embodiment, a first pattern may include a predetermined percentage, such as 10%, of yellow toner; a second pattern, staggered from the first pattern, may include the predetermined percentage of yellow and cyan toner; a third pattern, staggered from the first and second patterns, may include the predetermined percentage of yellow, cyan and magenta toner; and a fourth pattern, staggered relative to the first, second and third patterns, may include yellow, cyan, magenta and black toner. It is understood that the image transferred onto ITM belt 106 may have different toner pattern configurations.

Next, the output of TPS 202 is collected at each staggered pattern at 324. The output of TPS 202 may also be collected at a location to which no toner pattern has been transferred. With the output of TPS 202 collected, controller 140 determines at 326 the cause of the hard failure. Specifically, memory 142 may store a lookup table having stored therein values corresponding to expected toner measurements for each staggered pattern. The values may include values for diffuse and specular light deflected from ITM belt 106 for each staggered pattern location. By comparing the output of TPS sensor 202 with the values in the lookup table, controller 140 is able to determine, for example, whether a particular developer unit 104 and corresponding toner bottle 108 were the cause of the hard failure, such as due to a seal or biasing problem, whether the cause of the failure was the blade of cleaning unit 204 being flipped, etc. Controller 140 is able to identify the cause of the failure in part by identifying relatively large differences between the expected values in the lookup table and the measured outputs of TPS 202. In the event a particular developer unit 104 and corresponding toner bottle 108 were identified as the cause of the hard failure, the failing developer unit 104 and toner bottle 108 are disabled at 328 and limited printing is allowed to be performed without the disabled developer unit 104 and toner bottle 108, until imaging device 100 is serviced. In the event the output of TPS 202 corresponding to most or all of the staggered toner patterns are significantly different from their expected values, controller 140 may suspend all printing at 330 until imaging device 100 is serviced.

Figure 3:
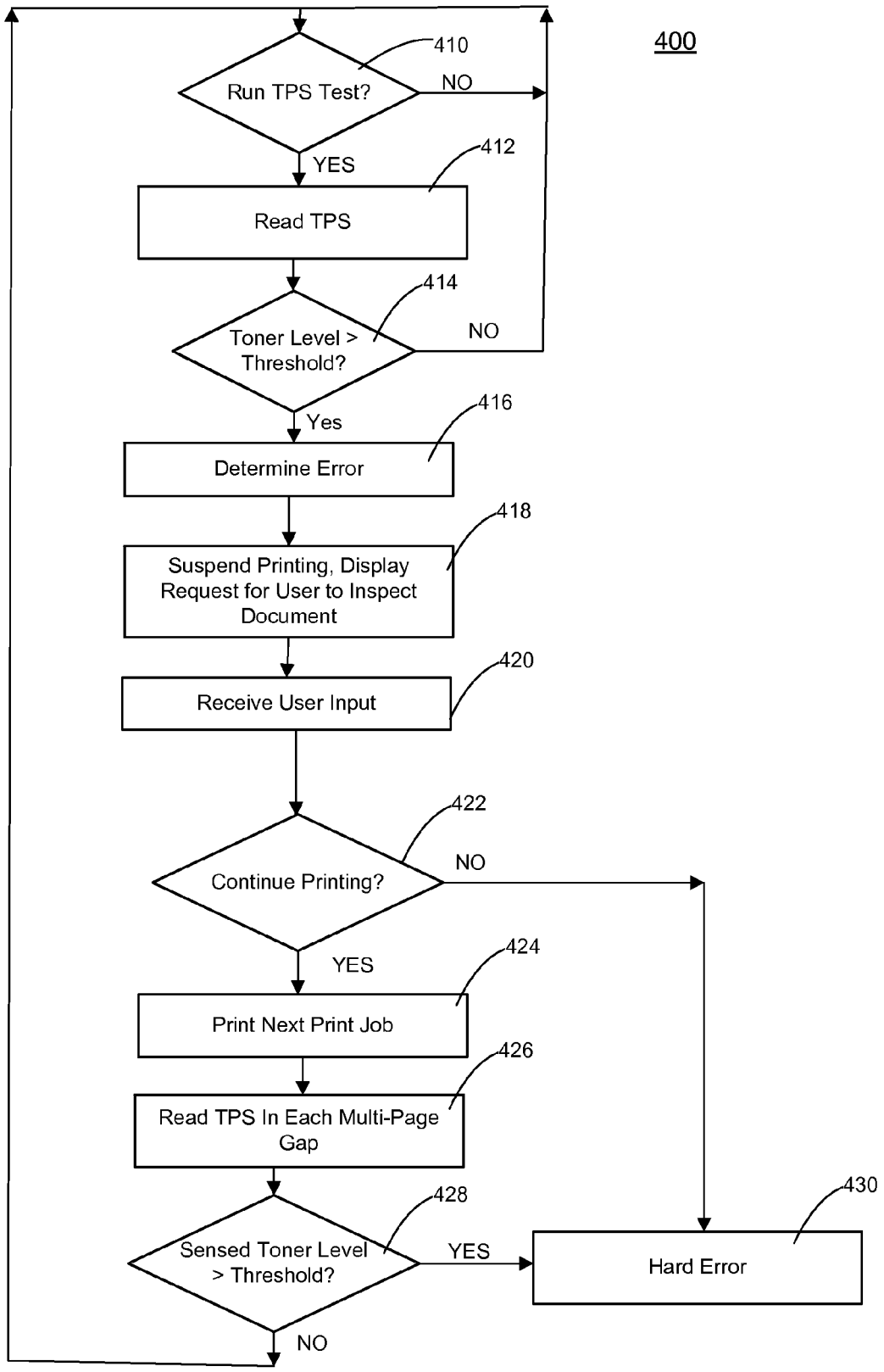
FIG. 3 is a flow diagram illustrating an operation of the imaging device according to another example embodiment.

FIG. 3 illustrates a method 400 of imaging device 100 according to another example embodiment. In this example embodiment, imaging device 100 is a DCD color printer. Method 400 uses TPS 202 during the interpage gap of print jobs to determine whether there is any toner therein. Testing for toner on ITM belt 106 during interpage gaps of a print job is seen as an effective test as there should be no toner on intermediate transfer member belt 106 during the interpage gaps. Detecting toner in the interpage gaps indicates that the charging system is failing for applying biases at first transfer 102 and second transfer 114, and for applying biases for toner development.

Initially, a determination is made at 410 whether a test is to be run. In one example embodiment, the test is run during every interpage gap of a multipage print job. As a result, a print job for printing more than one sheet will invoke the test. In another example embodiment, the test is run during less than every interpage gap of a multipage print operation, such as every other interpage gap of a multi-page print job. In another example embodiment, the test is run only on multipage print jobs for printing more than a predetermined number of pages.

Upon a determination that a test is to be run, the output of TPS 202 is received at 412 during the interpage gap of a multipage print job. Controller 140 then determines at 414 whether the output of TPS 202 at 412 is greater than a predetermined threshold. The predetermined threshold value may vary based upon the prior use of ITM belt 106, the prior use of TPS 202, or both, for example.

If the output of TPS 202 at 412 is less than the predetermined threshold, control returns to 410 to await the next test. The next test may be, for example, during the next interpage gap of the same multipage print job. If the output of TPS 202 at 412 is greater than the predetermined threshold, controller 140 identifies a clearable error at 416 and suspends printing operations at 418. Specifically, controller 140 causes the user interface of imaging device 100 to display the occurrence of the clearable error to allow a user to clear the error. The content, displayed on the user interface display panel, may request that the user, for example, to visually inspect the most recently printed page and decide whether the page indicates a printing problem. Imaging device 100 may receive feedback from the user at 420. Based upon the user feedback, controller 140 may decide at 422 whether to continue printing or halt printing. If the latter, controller 140 determines a hard error has occurred and controls imaging device 100 to halt all printing at 430 until imaging device 100 is examined by field service personnel. Otherwise, controller 140 may allow for continued printing at 424.

If printing is allowed to continue, the output of TPS 202 is collected at 426 during the interpage gap of the very next multipage print job. In the event the output of TPS 202 exceeds the predetermined threshold at 428, amounting to two instances in which the sensed toner level on ITM belt 106 exceeded the predetermined threshold, then controller 140 determines a hard error has occurred at 430 and, as described above, halts further printing until imaging device 100 is serviced. In the event the output of TPS 202 does not exceed the predetermined threshold at 428, then controls returns to act 410 until the next test is to be performed.

The foregoing description of methods and example embodiments of the disclosure have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An imaging device, comprising:

a plurality of developer units, each developer unit operative to transfer a developed toner image of a distinct color;

an intermediate transfer member belt operatively coupled to the developer units for transferring the developed toner images to the intermediate transfer member belt during an image transfer operation;

a sensing unit downstream of the developer units along the intermediate transfer member belt and operative to detect an amount of toner on the intermediate transfer member belt following the transfer of the developed toner images to the intermediate transfer member belt; and a controller coupled to the sensing unit and operative to compare a first output of the sensing unit during a printing operation to a predetermined threshold and selectively halting further printing operations based at least in part on the comparison, wherein upon the first output of the sensing unit being greater than the predetermined threshold, the controller resets the imaging device, powers on the imaging device after or as part of the imaging device being reset, moves the intermediate transfer member belt a predetermined distance after the imaging device is powered on, compares the predetermined threshold to a second output of the sensing unit during movement of the intermediate transfer member belt and performs the selective halting following an affirmative determination that each of the first output and the second output is greater than the predetermined threshold.

2. The imaging device of claim 1, wherein the sensing unit senses a level of reflectivity of the intermediate transfer member belt at one or more interpage gaps between successive sheets of media during the printing operation.

3. The imaging device of claim 1, wherein upon the first output of the sensing unit being greater than the predetermined threshold, the controller stores queued print jobs.

4. The imaging device of claim 3, wherein upon the second output of the sensing unit being less than the predetermined threshold, the controller causes the imaging device to print the stored queued print jobs.

5. The imaging device of claim 1, wherein upon the second output of the sensing unit being less than the predetermined threshold, the controller returns the imaging device to a normal mode of operation, compares to the predetermined threshold a third output of the sensing unit when the imaging device is performing at least one of the further printing operations, and upon the third output exceeding the predetermined threshold, the controller controls the imaging device to perform the selective halting until the imaging device is serviced.

6. The imaging device of claim 1, wherein upon each of the first output and the second output of the sensing unit being greater than the predetermined threshold, the controller attempts to identify at least one developer unit as failing, wherein upon a successful attempt, the controller disables the at least one developer unit from further printing operations and upon an unsuccessful attempt, the controller performs the selective halting.

7. The imaging device of claim 6, wherein the controller successfully attempting to identify the at least one failing developer unit comprises the controller indexing the intermediate transfer member belt a predetermined distance, causing a transfer of toner patterns to be staggered relative to each other along the intermediate transfer member, each toner pattern being formed from one or more developer units, collecting an output of the sensing unit for each toner pattern, comparing the collected outputs to values corresponding to expected sensing outputs, and identifying the at least one failing developer unit based upon the comparisons.

8. The imaging device of claim 1, wherein upon the first output of the sensing unit being greater than the predetermined threshold, the controller causes the imaging device to declare a clearable error and perform the selective halting following receiving user information pertaining to the clearable error.

9. The imaging device of claim 8, wherein based upon the received user information, the controller selectively controls the imaging device to return to a normal mode of operation.

10. The imaging device of claim 9, wherein following the imaging device returning to the normal mode of operation, the controller controls the imaging device to compare the predetermined threshold to the second output of the sensing unit during at least one of the further printing operations and upon the second output exceeding the predetermined threshold, perform the selective halting.

11. A method of diagnosing an error condition in an imaging device having an intermediate transfer member for transferring a toned image to sheets of media, the method comprising:

sensing a reflectance value of the intermediate transfer member at a first predetermined time;

comparing the sensed reflectance value at the first predetermined time to a predetermined threshold;

sensing a reflectance value of the intermediate transfer member at a second predetermined time;

comparing the sensed reflectance value of the intermediate transfer member at the second predetermined time to the predetermined threshold; and if each of the sensed reflectance value at the first predetermined time and the sensed reflectance value at the second predetermined time is greater than the predetermined threshold, selectively suspending further printing operations until the imaging device is serviced, wherein the imaging device comprises a color imaging device having a plurality of developer units, and the method further comprises if each of the sensed reflectance value at the first predetermined time and the sensed reflectance value at the second predetermined time is greater than the predetermined threshold, identifying at least one failing developer unit causing the sensed reflectance value at the first and second predetermined times being greater than the predetermined threshold, and upon an affirmative identification of the at least one failing developer unit, disabling the at least one failing developer unit from the further printing operations.

12. The method of claim 11, further comprising if the sensed reflectance value at the first predetermined time is greater than the predetermined threshold, prior to sensing the reflectance value of the intermediate transfer member at the second predetermined time, resetting the imaging device and rotating the intermediate transfer member while sensing the reflectance value thereof at the second predetermined time.

13. The method of claim 12, further comprising if the sensed reflectance value at the first predetermined time is greater than the predetermined threshold and the sensed reflectance value at the second predetermined time is less than the predetermined threshold, returning the imaging device to a normal mode of operation.

14. The method of claim 11, further comprising upon being unable to identify the at least one failing developer unit, performing the selective suspending of the further print operations.

15. The method of claim 11, wherein the identifying the at least one failing developer unit comprises indexing the intermediate transfer member, transferring toner from each developer unit to form a plurality of toner images that are staggered along the intermediate transfer member, sensing a reflectance value of each toner image, comparing the sensed reflectance value of each toner image to an expected reflectance value, and identifying the at least one failing developer unit based upon the comparisons.

16. The method of claim 11, further comprising if the sensed reflectance value at the first predetermined time is greater than the predetermined threshold, then requesting user information before comparing the sensed reflectance value of the intermediate transfer member at the second predetermined time.

17. The method of claim 16, further comprising receiving a user input and based upon the received user input, selectively suspending further printing operations until the imaging device is serviced.

18. The method of claim 11, further comprising if the second predetermined time is less than the predetermined threshold, returning the imaging device to a normal mode of operation.

* * * * *